US005211141A

United States Patent [19]

Hannibal et al.

[11] Patent Number: 5,211,141

[45] Date of Patent: May 18, 1993

[54] DRIVE ARRANGEMENT FOR A CAMSHAFT FITTED IN THE CYLINDER HEAD OF AN INTERNAL COMBUSTION ENGINE

[75] Inventors: Wilhelm Hannibal, Neckarsulm; Johannes Steinwart, Obersulm, both of Fed. Rep. of Germany

[73] Assignee: Audi, AG, Ingolstadt, Fed. Rep. of Germany

[21] Appl. No.: 784,424

[22] PCT Filed: Oct. 26, 1990

[86] PCT No.: PCT/EP90/01908

§ 371 Date: Nov. 6, 1991

§ 102(e) Date: Nov. 6, 1991

[87] PCT Pub. No.: WO91/07574

PCT Pub. Date: May 30, 1991

[30] Foreign Application Priority Data

Nov. 11, 1989 [DE] Fed. Rep. of Germany ..... 3937628

[51] Int. Cl.[5] ..... F01L 1/34; F15B 15/00

[52] U.S. Cl. ..... 123/90.17; 123/90.31; 74/568 R; 74/567; 464/1; 464/2

[58] Field of Search ..... 123/90.15, 90.17, 90.31; 74/568 R, 567; 464/1, 2, 160

[56] References Cited

U.S. PATENT DOCUMENTS

| | | | |
|---|---|---|---|
| 4,747,375 | 5/1988 | Williams | 123/90.15 |
| 4,754,659 | 7/1988 | Rietsch | 464/160 |
| 4,787,345 | 11/1988 | Thoma | 123/90.17 |
| 4,976,229 | 12/1990 | Charles | 123/90.31 |
| 5,033,323 | 7/1991 | Janson | 464/160 |

FOREIGN PATENT DOCUMENTS

| | | | |
|---|---|---|---|
| 296885 | 12/1988 | European Pat. Off. | 123/90.17 |
| 3534412 | 4/1986 | Fed. Rep. of Germany | 123/90.15 |
| 1201546 | 12/1959 | France | 464/2 |
| 159320 | 8/1985 | Japan | 123/90.17 |
| 134012 | 5/1989 | Japan | 123/90.17 |

*Primary Examiner*—E. Rollins Cross
*Assistant Examiner*—Weilun Lo
*Attorney, Agent, or Firm*—Kane, Dalsimer, Sullivan, Kurucz, Levy, Eisele and Richard

[57] ABSTRACT

A drive arrangement for a camshaft (3) of an internal combustion engine is fitted with a facility for rotating the camshaft (3) relatively to a coaxial drive wheel (5) having a switching component (6), which interacts via a spur toothing (7) with the drive wheel (5) and via a helical gearing (8) with the camshaft (3) and can be axially shifted by a servo motor (13). The servo motor (13) is disposed at the end of the camshaft averted from the drive wheel (5). This prevents the axial length of the internal combustion engine from being extended beyond the drive wheel (5) by the servo motor.

2 Claims, 1 Drawing Sheet

DRIVE ARRANGEMENT FOR A CAMSHAFT FITTED IN THE CYLINDER HEAD OF AN INTERNAL COMBUSTION ENGINE

The invention relates to a drive arrangement for a camshaft mounted in the cylinder head of an internal combustion engine, corresponding to the introductory portion of claim 1.

In the case of a known drive arrangement of this type (German Auslegeschrift 36 16 234), the servo motor is disposed axially in front of the drive wheel in a machine housing cover. Due to this arrangement, the dimensions of the internal combustion engine in the longitudinal direction are increased. If the internal combustion engine is installed longitudinally in a motor vehicle, this leads to space problems, since a flat hood, which drops off towards the front, is desirable for aerodynamic reasons. It is therefore hardly possible to install such an internal combustion engine with variable valve control in an existing vehicle.

It is an object of the invention to provide a drive arrangement of the type, with which the problems described on installing the internal combustion engine in a motor vehicle are avoided.

Pursuant to the invention, this objective is accomplished owing to the fact that the servo motor is disposed adjacent to that end of the camshaft, which is averted from the drive wheel, and that the control element of the servo motor is connected with the switching component through a switching rod, which is put through the camshaft.

In the case of the inventive proposal, the servo motor can be accommodated without difficulties, since it is located at a place, at which the hood rises towards the windshield.

Preferably, the drive wheel and the camshaft are mounted independently of one another in the cylinder head, so that the structure is significantly simpler than that of the state of the art. In order to be able to compensate for alignment errors between the drive wheel and the camshaft, the two external tooth systems of the switching component are disposed on separate sections, which are connected together so that they cannot rotate relative to one another, but yet so that the angle between them can be varied.

Figure 1:
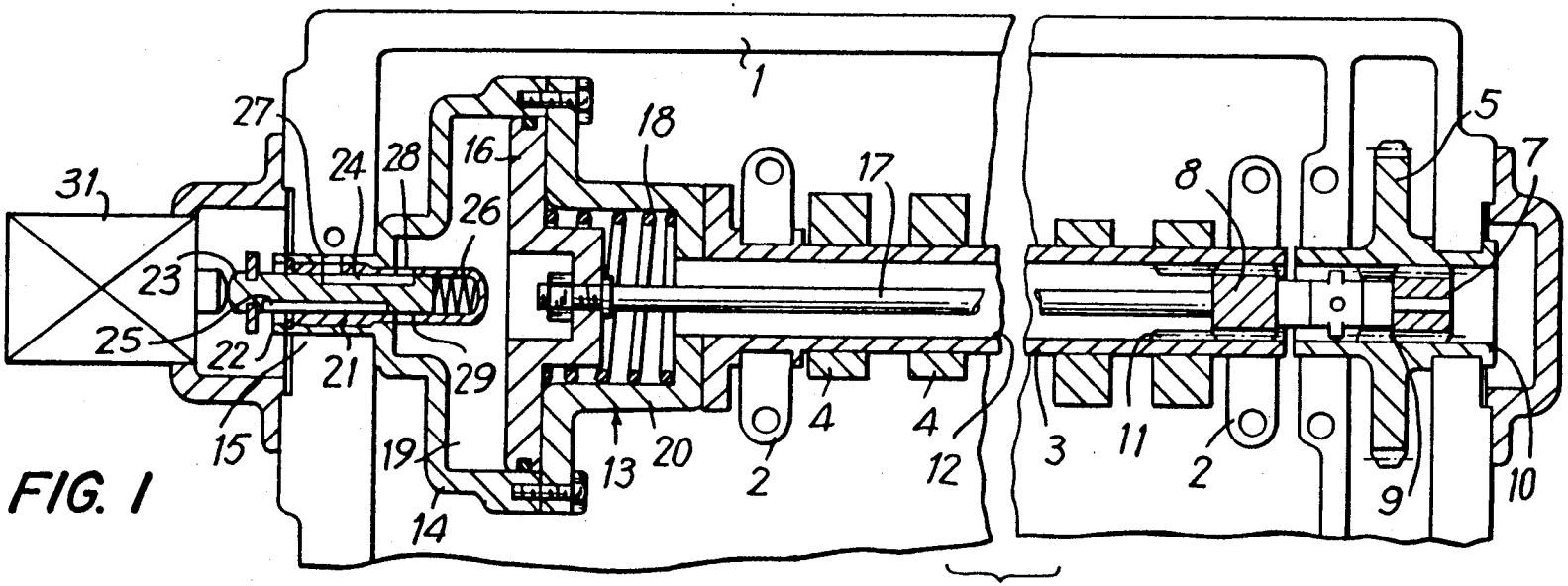
Figure 2:
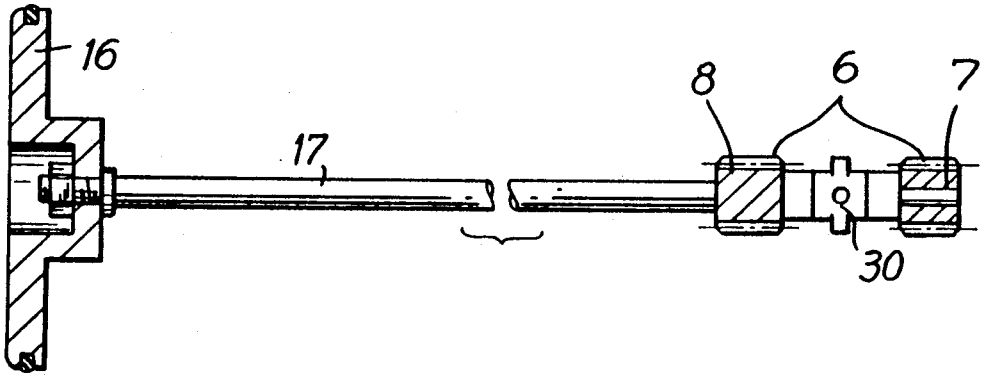

An embodiment of the invention is described in the following, with reference to the drawings, in which FIG. 1 shows a partial longitudinal section of a cylinder head of an internal combustion engine in a horizontal plane through a camshaft and FIG. 2 shows a view of the subassembly comprising the switching element, the switching rod and the control element of the servo motor.

In FIG. 1, the cylinder head of a valve-controlled, reciprocating piston internal combustion engine, is labelled 1. In this internal combustion engine, a camshaft 3, which carries the cams 4, with which the inlet and/or outlet valves of the internal combustion engine, which are not shown, are operated, is mounted on bearing 2. Coaxially with the camshaft 3, a drive wheel 5, which is driven by the crankshaft of the internal combustion engine, is mounted in the cylinder head 1. A switching component 6, which has two axially adjacent external tooth systems 7 and 8, which include different angles with the longitudinal center line of the cam shaft 3, serves to transfer the drive from the drive wheel 5 to the camshaft 3. In the embodiment, the external tooth system 7 is constructed as a spur toothing and the external tooth system 8 as a helical gearing. However, the external tooth system 8 could also be constructed as the spur toothing and the external tooth system 7 as the helical gearing.

Finally, there is also the possibility of constructing the external tooth system 7 as well as the external tooth system 8 as a helical gearing, however with the opposite or a different inclination. The external tooth system 7 engages a corresponding internal tooth system 9 in the hollow hub 10 of the drive wheel 5 and the external tooth system 8 engages the corresponding internal tooth system 11 in a longitudinal borehole 12 of the camshaft 3. The switching component 6 can be shifted axially by a servo motor 13. The servo motor is disposed at the end of the camshaft 3 that is averted from the drive wheel 5 and, in the embodiment, has a hydraulic cylinder 14, which is connected through its cover 20 with the camshaft 3, so that there can be not rotation between said cover and camshaft, and is mounted with its hub 22 in a bearing 15, which is coaxial with the camshaft bearings 2. In the cylinder 14, a piston 16 is movably disposed, from which a switching rod 17 extends, which is connected with the control element 6. A spring 18 in the cover 20 endeavors to move the piston 16 into its left end position in FIG. 1. The piston forms a hydraulic chamber 19 with the cylinder 14. In the hub 22, there is a sleeve 21, in which a valve body 23 with two longitudinal grooves 24 and 25 is movably disposed. The first of these grooves 24 is in communication over an opening 28 in the sleeve 21 with the hydraulic chamber 19 and the second of these grooves 25 is open towards the interior of the cylinder head 1. The valve body 23 is subjected to the action of a spring 26, which endeavors to hold the valve body 23 in the position shown, in which the first longitudinal groove 24 is in communication over a duct 27 in the hub 22 and in the sleeve 21 with the bearing 15, so that oil under pressure is supplied from the bearing 15 to the hydraulic chamber 19 and the piston 16 is shifted into the right end position shown against the action of the spring 18. The valve body 23 can be shifted to the right by an electromagnet 31 against the action of the spring 26. In this position, the first longitudinal groove 24 is gradually shut off from the duct 27 and the second longitudinal groove 25 is in communication with the hydraulic chamber 19 through a further opening 29 in the sleeve 21. Owing to this, the pressure in the hydraulic chamber 19 can decline and the spring 18 can shift the piston 16 to the left. This brings about a corresponding shift in the control element 6, whereby, because of the helical gearing 8, 11, a rotation of the camshaft 3 relative to the drive wheel 5 takes place.

As can be seen, the drive wheel or its hub 10 is mounted independently of the camshaft 3 in the cylinder head 1. In order to compensate for alignment errors between the hub 10 and the camshaft 3, the external tooth systems 7 and 8 of the switching component 6 can be disposed on separate sections, which are connected by a universal joint 30, indicated diagrammatically in FIG. 2, so that they cannot rotate relative to one another, but yet so that the angle between them can be varied.

In the embodiment, the servo motor 13 is shown as a hydraulic motor, the control element of which (piston 16) is shifted by the spring 18 in one direction and by oil pressure in the other direction. Instead of this singly acting hydraulic motor, it is also possible to provide a doubly acting hydraulic motor, which corresponds to the state of the art and for which the control element is moved in both directions by oil pressure.

Due to the disposal of the servo motor 13 at the end of the camshaft 3 averted from the drive wheel, the space otherwise required for accommodating the servo motor in front of the drive wheel 5 is saved. By these means, the problems of accommodating the internal combustion engine in the engine compartment of a motor vehicle are reduced considerably.

We claim:

1. A drive arrangement for a camshaft (3) mounted in the cylinder head (1) of an internal combustion engine with a facility for rotating the camshaft relative to a drive wheel (5) coaxially in driving connection with the crankshaft of the internal combustion engine, which facility has a switching component (6), which can be shifted axially between two end positions by a servo motor (13) and interacts over a first gear-tooth system (7, 9) with the drive wheel 5 and over a second gear-tooth system (8, 11) with the camshaft (3), each gear-tooth system comprising an external tooth system (7 and 8), which is provided at the switching component (6), and an internal tooth system (9 and 11), which is provided in the hub (10) of the drive wheel (5) and in the camshaft (3), and the two gear-tooth systems enclosing different angles with the longitudinal center line of the camshaft, characterized in that the servo motor (13) is disposed adjacent to the end of the camshaft (3) averted from the drive wheel (5) and that the control element (16) of the servo motor (13) is connected with the switching component (6) by a switching rod (17), which is put through the camshaft (3).

2. The drive arrangement of claim 1, characterized in that the drive wheel (5) and the camshaft (3) are mounted independently of one another in the cylinder head (1) and that the two external tooth systems (7, 8) of the switching component (6) are disposed on separate sections, which are connected so that they cannot rotate relative to one another, but yet so that the angle between them can be varied.

* * * * *